US005163667A

United States Patent [19]

Rebeaud

[11] Patent Number: 5,163,667

[45] Date of Patent: Nov. 17, 1992

[54] SHEET TRANSFER DEVICE WITH SUCTION TABLE ON A MACHINE PRODUCING PACKAGE

[75] Inventor: Jean-Claude Rebeaud, Le Mont, Switzerland

[73] Assignee: Bobst S.A., Switzerland

[21] Appl. No.: 692,464

[22] Filed: Apr. 16, 1991

[30] Foreign Application Priority Data

Apr. 25, 1990 [CH] Switzerland ..... 01405/90

[51] Int. Cl.[5] ..... B65H 5/08

[52] U.S. Cl. ..... 271/98; 271/99; 271/102; 271/108; 271/132; 271/267; 271/107; 414/676; 406/88

[58] Field of Search ..... 271/5, 14, 98, 99, 102, 271/107, 108, 132, 267, 268; 221/211; 414/676; 406/86, 88, 73

[56] References Cited

U.S. PATENT DOCUMENTS 3,202,420 8/1965 Dovey ..... 271/32
3,226,108 12/1965 Bishop ..... 271/32
3,510,126 5/1970 Romanens ..... 271/32
4,089,518 5/1978 Vollrath ..... 271/98 X

FOREIGN PATENT DOCUMENTS 394549 6/1933 France ..... 271/26
440337 12/1967 Switzerland .

*Primary Examiner*—H. Grant Skaggs
*Assistant Examiner*—Carol Lynn Druzbick
*Attorney, Agent, or Firm*—Hill, Van Santen, Steadman & Simpson

[57] ABSTRACT

A suction table which, in a machine converting sheets into package, transfers the last, lowermost sheet of a batch to a subsequent processing station. The table is provided with numerous blowing and sucking nozzles and is fitted on a hollow frame movable with regard to a fixed distributory housing which provides sucking and blowing action. The housing comprises a distributory shaft and tubes movable with respect to the table and thereby sliding within corresponding guides formed in the frame. The shaft and tubes are provided with cooperating ducts which will allow the nozzles to suck or blow as required by the angular position of the distributory shaft and the position of the table.

16 Claims, 7 Drawing Sheets

SHEET TRANSFER DEVICE WITH SUCTION TABLE ON A MACHINE PRODUCING PACKAGE

BACKGROUND OF THE INVENTION

The present invention concerns a transfer device for a machine converting plate or sheetlike matter into package, whereby the lowermost sheet is transferred from a sheet batch to the subsequent processing station.

The patent CH-A-440337, and corresponding U.S. Pat. No. 3,510,126, describes a transfer table provided with telescope-type suction cups, suction being achieved owing to the difference of pressure between two chambers of a body of every suction cup, both chambers being connected to a vacuum pump. In line with this arrangement, it has appeared appropriate to have every suction cup connected at the end of the sheet transfer to a source of pressure for quicker separation of the sheet with regard to the suction table, the quicker response to accelerate production. However, because of present production speeds which are likely to soon reach 10,000 sheets per hour, the present means for having each nozzle alternately blow or such, made of fixed valves connected through flexible air suction or pressure ducts to a movable table and actuated by control means themselves kinematically connected to the shift of the suction table, are no longer able to ensure their function on account of their slow response with regard to the time available for the accomplishment of the various control cycles. Besides that, the air contained in the flexible ducts represents a considerable inert mass retarding pressure and suction to a great extent. Moreover, such flexible ducts have a tendency to develop fatigue fissures.

In the patent U.S. Pat. No. 3,202,420 every suction cup of the movable table is connected through flexible ducts to a fixed valve with a rotary distribution flap switching the nozzle to the atmosphere or to suction.

The patent U.S. Pat. No. 3,226,108 describes a suction table provided with several suction holes. The movable table is connected to a lengthwise distributory housing by means of a cylindrical tube fitted to the table frame, and not by a flexible duct, the tube communicating with all suction holes and being able to slide within the corresponding bore of the distributory housing in the course of the sheet transfer. The bore is provided with two apertures longitudinally separated by an appropriate distance and arranged to connect alternately the suction holes to a source or aspiration or to the atmosphere. If this system has the advantage of discarding the drawbacks of the flexible ducts, it has nonetheless the disadvantage of providing only a limited number of possibilities for regulating the alteration of suction or pressure required for the control of the table. The sucking and blowing nozzles are divided up into several assemblies each of which require its own control cycle.

SUMMARY OF THE INVENTION

The objects of the present invention are to eliminate the aforementioned drawbacks on a sheet transfer table.

In a transfer device for a machine for converting plate or sheet-like matter into package, and acting to transfer the last, lowermost, sheet of a batch to a subsequent processing station. The invention provides a transfer table provided with two assemblies of nozzles of which the nozzles of the same assembly can be connected together through a control means alternately to either a source of aspiration to operate suction cups on the nozzles or to a source of pressure allowing the nozzles to blowingly detach the sheet from the table.

The invention provides a frame to support the table and means for guiding the table during the transfer stroke.

The control means comprise a fixed housing provided with inlet and outlet chambers for suction and pressure, the housing including a built-in distributory shaft arranged axially perpendicular to the sheet transfer stroke direction. The radial periphery of the distributory shaft has several groove-shaped conduits designed for connecting the inlet chambers to the outlet chambers as determined by the angular position of the distributory shaft.

The housing is extended on one of its sides by several conduits arranged in the transfer direction and connected to the outlet chambers.

Several guiding bores are formed in the frame of the table, each bore allowing inside free, but tight fitting, sliding of one of the conduits so as to enable the shifting of the table with regard to the fixed housing during the transfer stroke.

Apertures are formed on each conduit and arranged, as determined by the lengthwise position of each conduit, to move in alignment with corresponding apertures formed on each guiding bore in order to connect either the pressurized or vacuum conduits to the passages formed inside the frame connected to the various nozzles.

In a development of the invention, a first assembly of large nozzles is situated in the rear area of the table, and a second assembly of small nozzles is situated in the front area of the table, wherein "rear" is closer to the fixed housing and "front" is further away from the fixed housing.

In another development of the invention the frame comprises three guiding bores and three corresponding conduits of which the first one of each grouping is arranged to direct compressed air to the small and the large nozzles, the second grouping is arranged to provide suction to the large nozzles, and the third grouping is to provide suction to the small nozzles.

The distributory shaft can be fashioned to be hollow and equipped with a first assembly of suction grooves and with a second assembly of pressure grooves opposite the first assembly of suction grooves. Some of the grooves can be connected inside the hollow distributory shaft by radial orifices in such a way that with a revolution of 360° of the distributory shaft corresponding to the complete reciprocation cycle of the table in the course of a transfer of a sheet, and when the table is in its forward section of its stroke, the pressure chamber will be connected to the common conduits of the small and large nozzles by at least an aperture formed at the front end of the first grouping with a view to directing compressed air to both the small and large nozzles.

As a further development of the invention a mechanism can be provided for retarding the beginning of suction of a transverse cycle by angular positioning of the distributory shaft as required by the length of the sheets of a given batch.

The nozzles of the exemplary embodiment are advantageously fashioned having a first, fixed tube, a second tube making up a first tight chamber with the first tube, and a third, movable tube topped by a suction cup and thus making up a second tight chamber with the second tube. The two described chambers are interconnected by inside conduits of the first tube so that when the second chamber contains a vacuum, a difference in pressure being produced between the two chambers, results in a shift of the third tube.

The present invention provides a reliable transfer machine having the ability for quick response with regard to the time available for the accomplishment of the various control cycles and resulting fast production speeds.

DETAILED DESCRIPTION OF THE PREFERRED EMBODIMENTS

Figure 1:
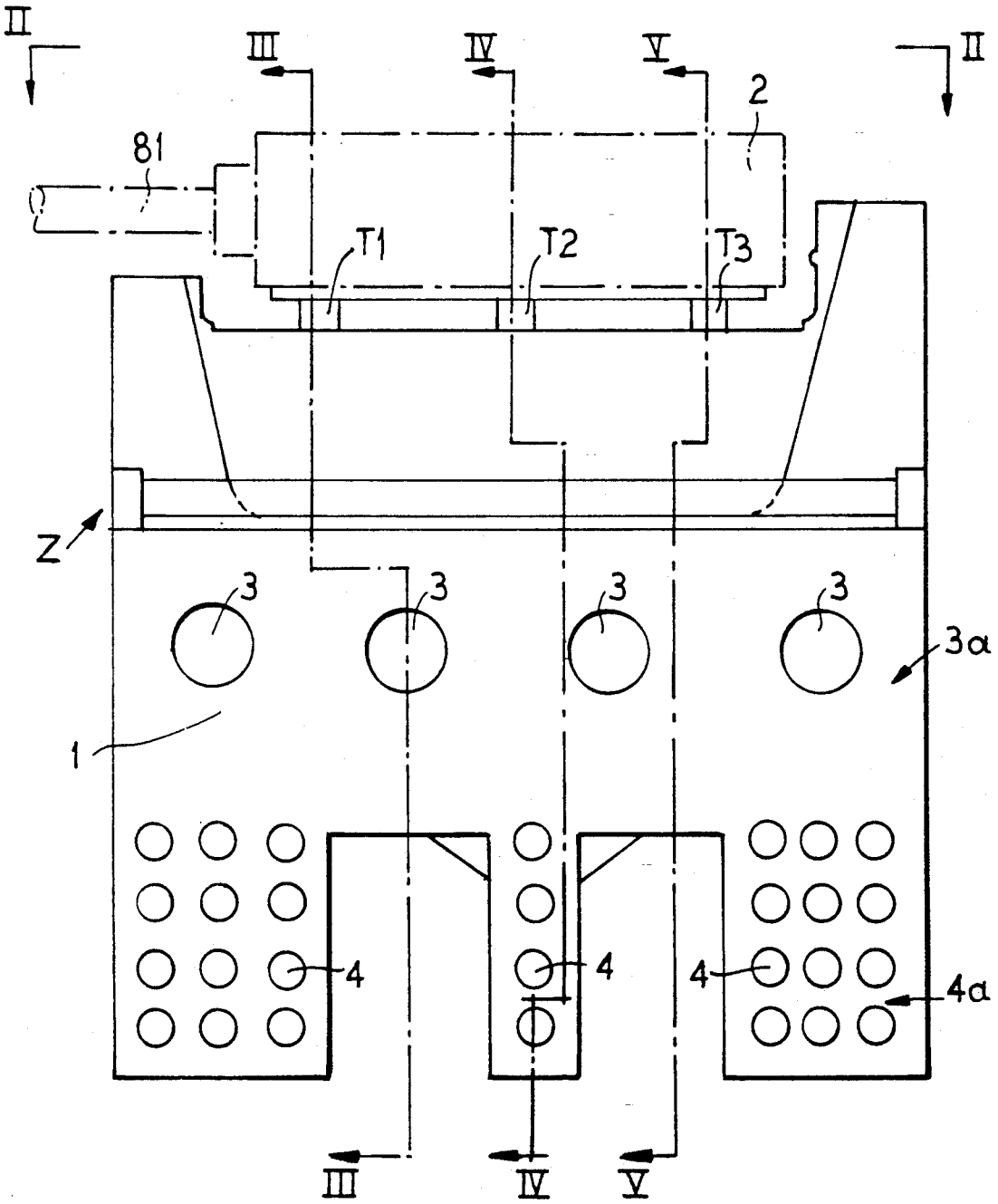
FIG. 1 is a top plan view of a table according to the invention.

FIG. 1 shows transfer device Z which includes a movable table 1 and a rear, fixed housing 2 for providing alternate blowing and sucking.

An upper portion 1*a* of the table 1 holds a first assembly of five large nozzles 3 situated in a rear area 3*a* with regard to the direction of the table transfer motion, as well as a plurality of small nozzles 4 situated in a front area 4*a*. In the exemplary embodiment 28 small nozzles are employed.

Figure 3:
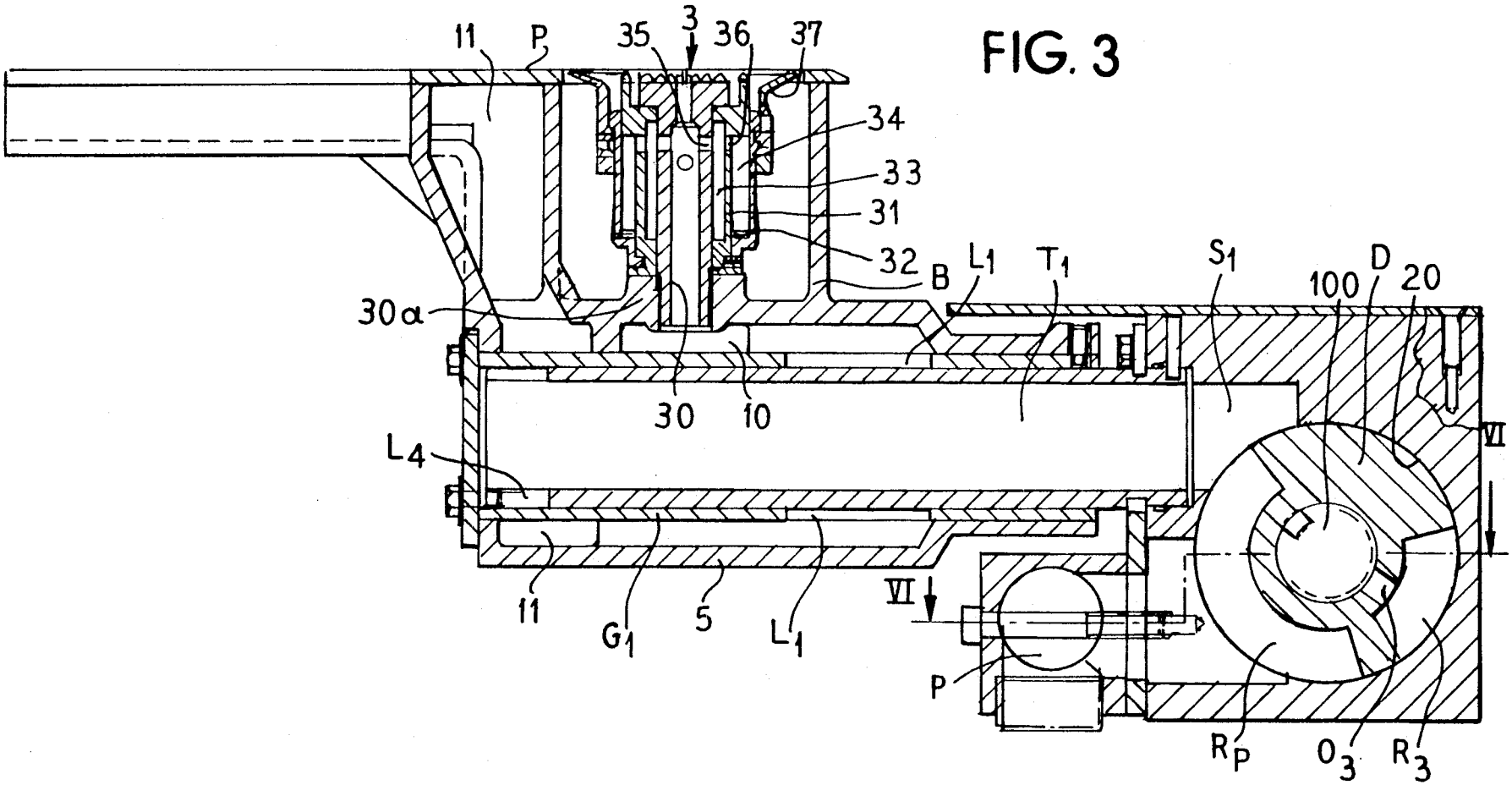
FIG. 3 is a sectional view taken generally along III—III of FIG. 1.
Figure 4:
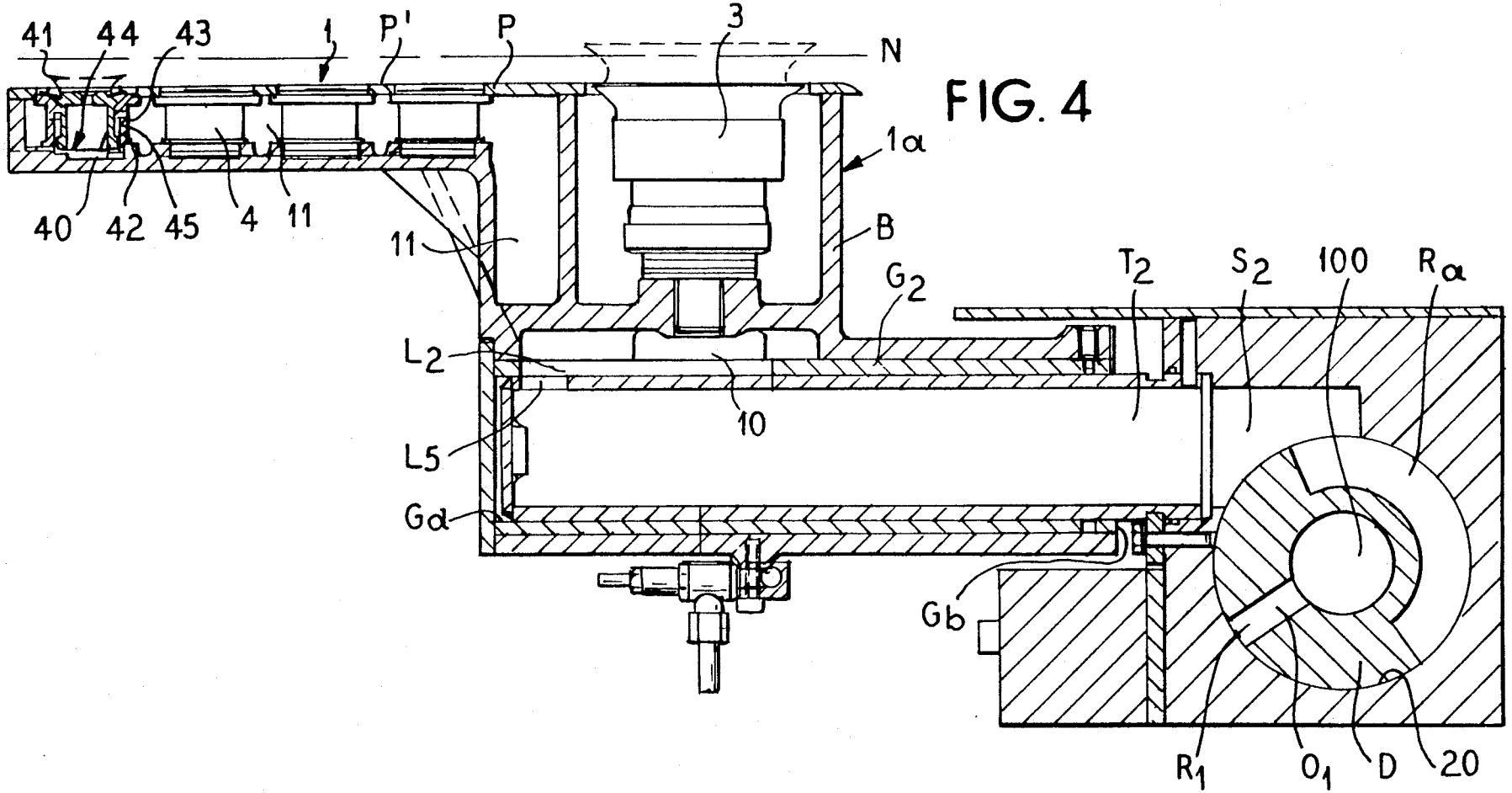
FIG. 4 is a sectional view taken generally along IV—IV of FIG. 1.
Figure 5:
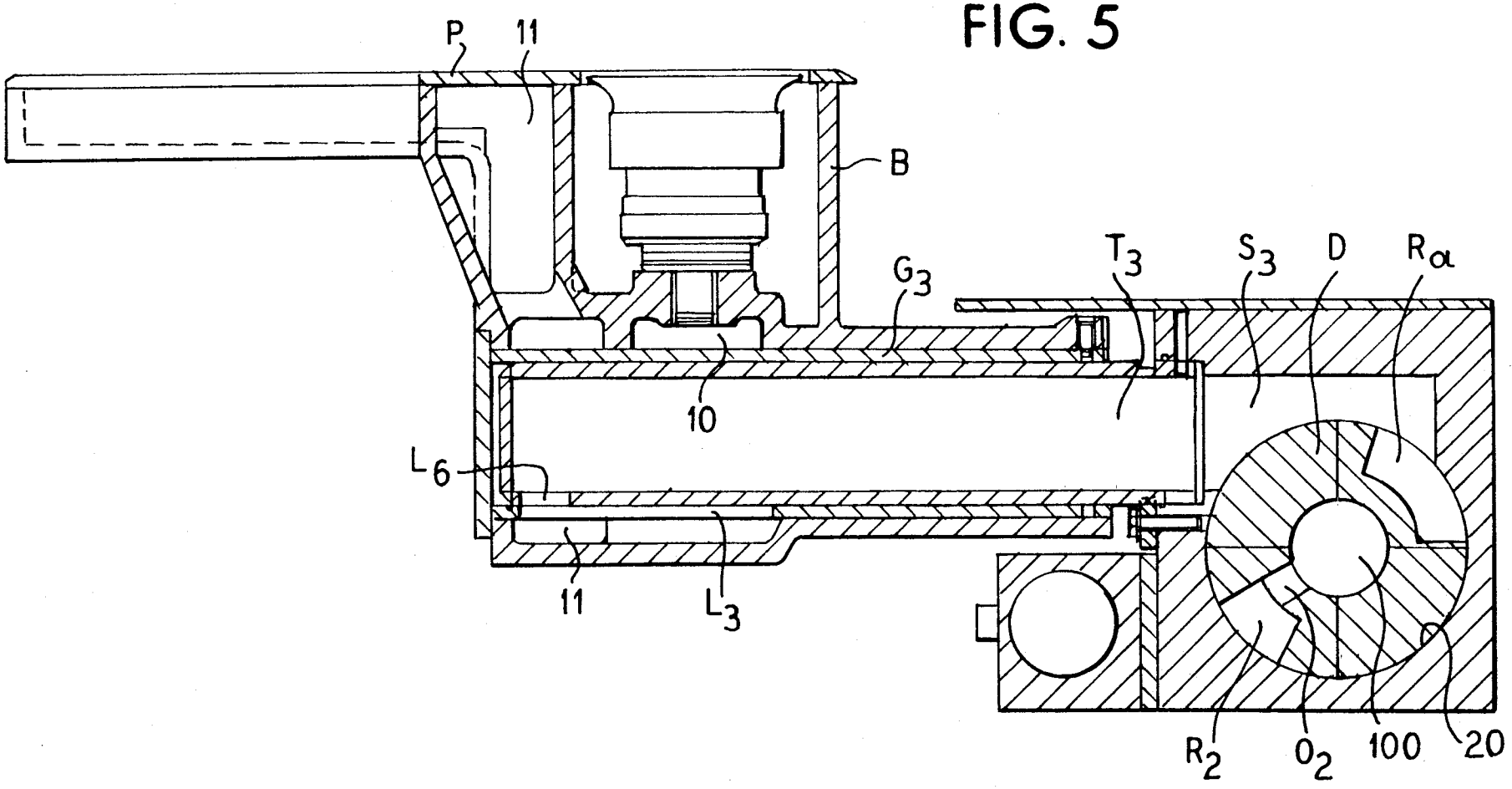
FIG. 5 is a sectional view taken generally along V—V of FIG. 1.
Figure 6:
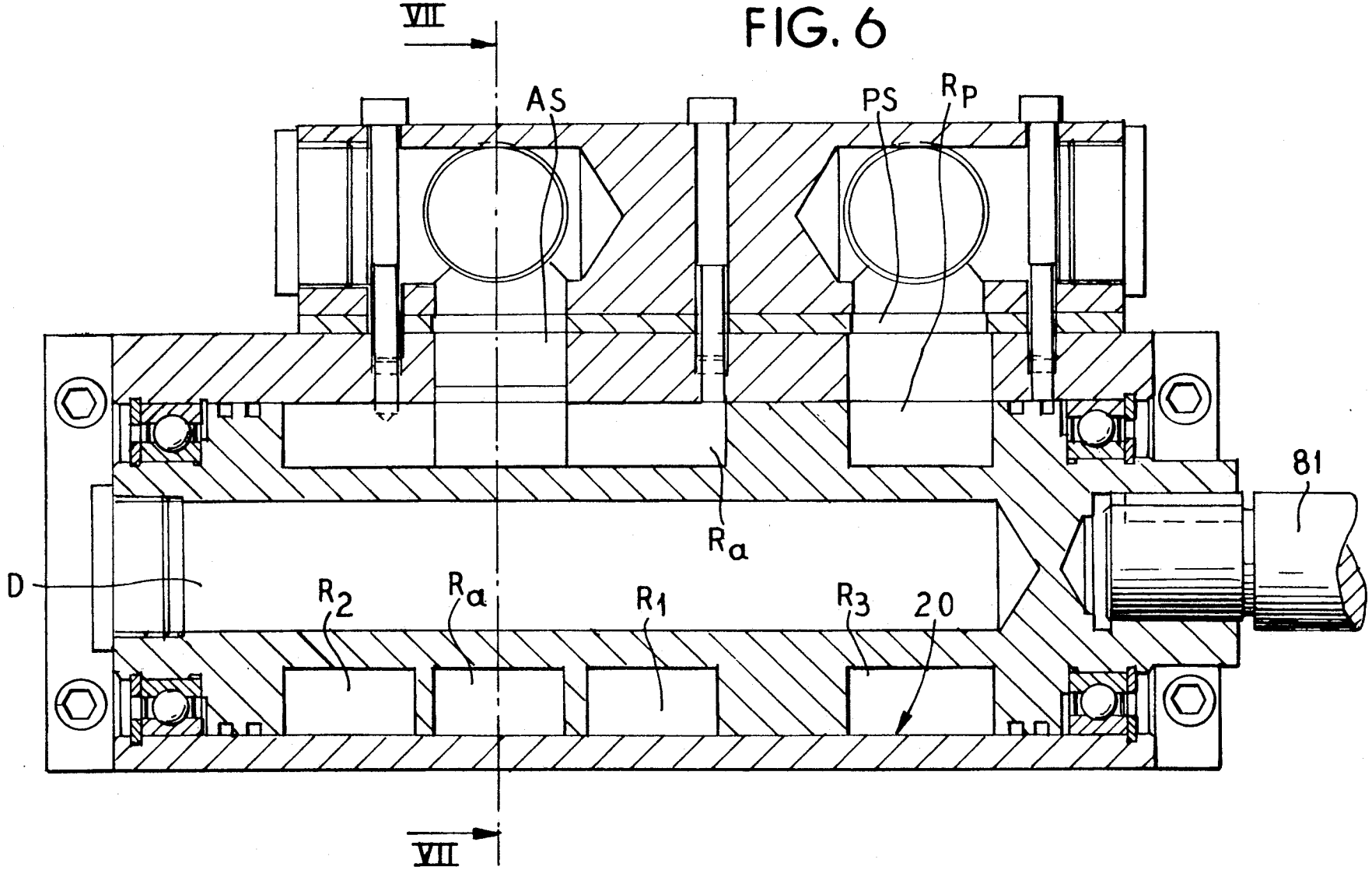
FIG. 6 is a sectional view taken generally along VI—VI of FIG. 3.

As shown in FIGS. 3–5, the table consists of a hollow frame B whose upper portion 1*a* is shut by a plate P and whose surface is perforated to expose the small and large nozzles 3, 4.

The body of a typical large nozzle 3 consists essentially of: a first tube 30 screwed onto an inner rib 30*a* of the hollow frame B, a second, fixed, tube 31 surrounding the first tube 30, and a third tube 32 surrounding the second tube 31 along which it is able to slide. A first tight chamber 33 is formed between the first tube 30 and the second tube 31. A second tight chamber 34 is formed between the second tube 31 and the third tube 32. The top of the third tube 32 is provided with an elastic suction cup 37. The first tube 30 is connected, at one end 30*b*, to a main duct 10 for alternate blowing and sucking produced within the frame B and involving all large nozzles 3; and the first tube 30 is connected at another end, through a radial orifice 35 to the first tight chamber 33. The first tight chamber 33 is connected to the second tight chamber 34 through a radial orifice 36 on the second tube 31.

When the main duct 10 is under suction, a difference of pressure will arise between the two chambers 33 and 34 causing an upward shift of the third tube 32 and thereby of the elastic suction cup 37 which can thus be shifted from the position shown in full lines in FIG. 4 where it is flush with a top surface P' of the plate P to the position shown in dashed lines situated above the level line N related to a lower end of a sheet batch plate used as a gauge (not represented) in the front area of the sheet batch. More details about the telescope-type suction cups are contained in the above-mentioned patent CH-A-440337 and corresponding U.S. Pat. No. 3,510,126 incorporated herein by reference.

The large nozzles 3 have for purpose to fetch the lowermost sheet of the batch and to pull it down flat onto the table 1. In the course of the movement of the table 1, the large nozzles 3 remain behind the sheet batch gauge.

The small nozzles 4 are designed, and operate, in almost the same, though simplified, way as the large nozzles 3. FIG. 4 shows that the small nozzles 4 have also a telescope-type tube 40 topped by an elastic suction cup 41 which can occupy a first position flush with the upper surface P' of the plate P, and a second position, represented in dashed lines, situated underneath the level N since the small nozzles 4 are to move beyond the batch gauge. The body of every small nozzle 4 also includes a tight chamber 42 contained between the telescope-type tube 40 and a fixed tube 45 fitted inside the hollow frame B. Both tubes 40, 45 as well as the chamber 42 are connected through appropriate passages 44, 43 to a main blowing or sucking duct 11 common to all the small nozzles 4. The small nozzles, or telescope-type suction cups 4 are arranged to be applied in a bent area of the sheet which, at an earlier stage, has been separated from the batch and flattened onto plate P by the large suction cups 3.

Inside the frame B and underneath the plate P arranged on a parallel horizontal plane, three guiding bores $G_1$, $G_2$, $G_3$ with the shape of cylindrical hollow tubes are arranged along the sheet transfer direction. A front end Ga of the bores is closed and a rear end Gb is open.

The first guiding tube $G_1$ which, as will be described below, has for a purpose the direction of compressed air to the small and large suction cups 3, 4. The first guiding tube G, is provided with an aperture or radial slot $L_1$ situated rearwardly and communicates with both main ducts 10, 11 of the small and large nozzles 3, 4. The second guiding tube $G_2$ directing suction to the large suction cups 3, is provided with a radial slot $L_2$ situated frontwardly and communicates with the main duct 10 of the large suction cups 3. The third guiding tube $G_3$ directing suction to the small suction cups 4, is provided with a radial slot $L_3$ situated frontwardly and communicates with the main duct 11 of the small suction cups 4.

Figure 2:
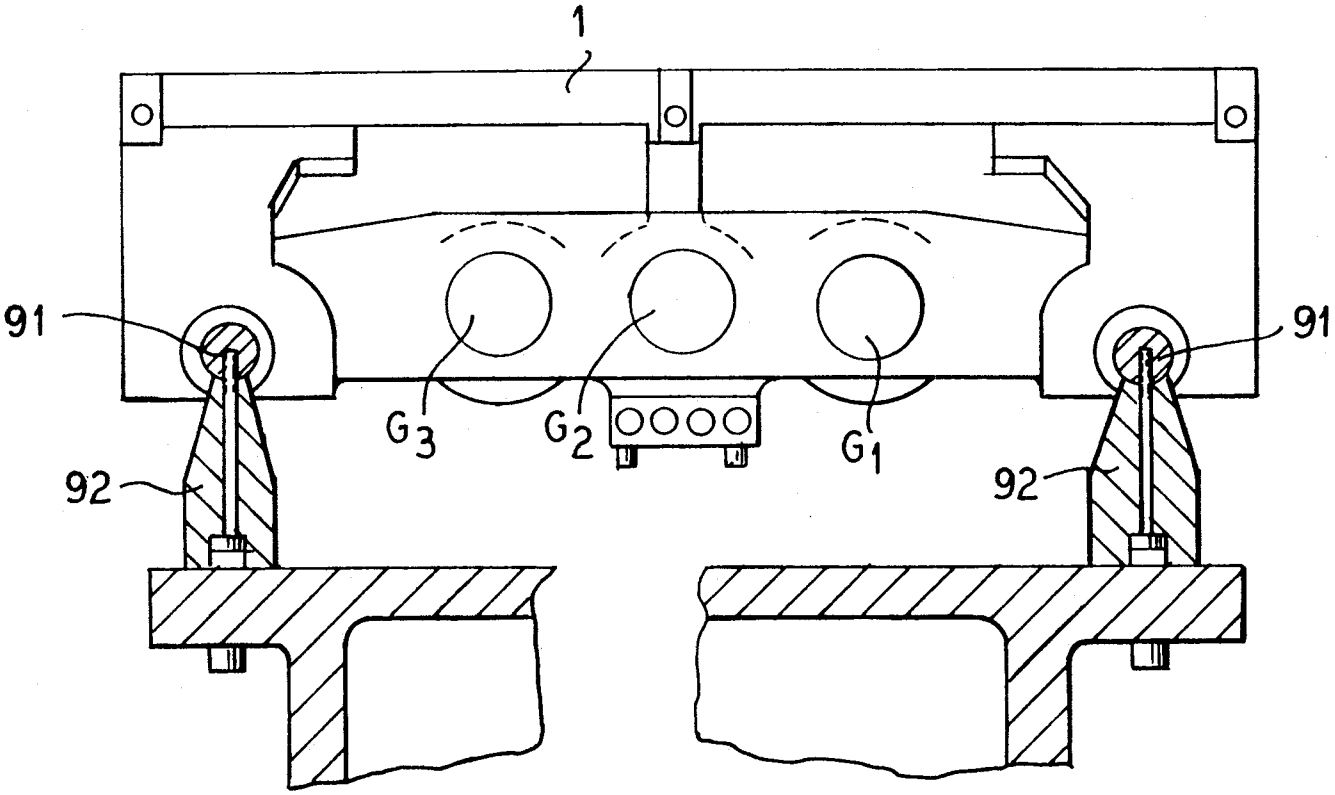
FIG. 2 is a rear view in a direction of II—II of FIG. 1.
Figure 7:
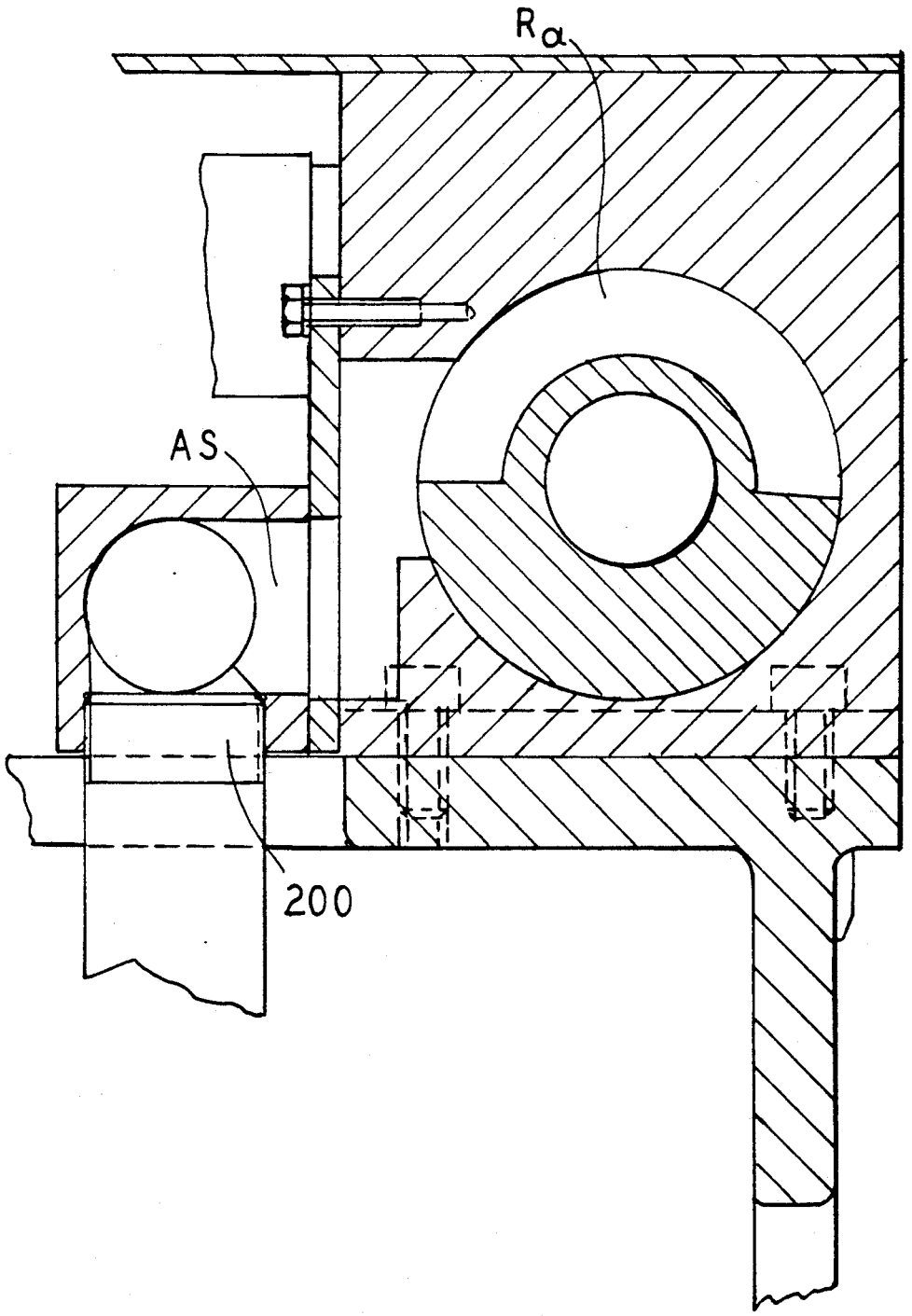
FIG. 7 is a sectional view taken generally along VII—VII of FIG. 6.

The bore 20 formed in the fixed distributory housing 2 contains a horizontally fitted, hollow, distributory shaft D closed at both ends and arranged perpendicularly to the transfer direction. The distributory shaft D is rotated at one of its ends by a drive shaft 81. As shown in FIG. 7, the housing 2 comprises a suction inlet chamber AS connected through a duct 200 to a source of aspiration (not represented), and similarly a pressure inlet chamber PS is connected through a duct 210 to a source of pressure (not represented). As shown in FIGS. 3, 4 and 5, the housing 2 also comprises three outlet chambers $S_1$ to $S_3$ of which each is connected to a cylindrical hollow duct $T_1$ to $T_3$ respectively, said hollow ducts $T_1$ to $T_3$ emerging from the housing 2 and penetrating each into one of the three guiding tubes $G_1$ to $G_3$. The fixed housing 2 and the movable table 1 are arranged so that the cylindrical ducts $T_1$ to $T_3$ will be able to slide freely and with effective leak tightness within the guiding tubes $G_1$ to $G_3$ along a stroke which is at least equal to the one required for a sheet transfer. For this purpose, as shown in FIG. 2, the frame B of the table 1 is provided with guiding bushings 90 able to slide along the bars 91 fitted on a support 92.

The radial periphery of the distributory shaft D is fashioned to have a first suction groove $R_a$ which, depending on the angular position of the shaft D, can connect the suction inlet chamber AS to the outlet chambers $S_2$ and $S_3$. The radial periphery also will be provided with a groove $R_p$ which, as required by the angular position of the shaft D, is to connect the pressure inlet chamber PS to the outlet chamber $S_1$. In a position diametrically opposed to the suction and pressure grooves $R_a$ and $R_p$ respectively, auxiliary grooves $R_1$, $R_2$ and $R_3$ respectively will be connected each to the hollow shaft through radial orifices $O_1$ to $O_3$ respectively.

The first cylindrical duct $T_1$ is provided with at least one radial slot $L_4$ situated at its open front end and arranged with the table 1 in a forward part of the transfer stroke, to move to a position opposite the slot $L_1$ of the guiding tube $G_1$ in order to connect the duct $T_1$ to the common ducts 10, 11 of the large and small nozzles 3, 4. The second cylindrical duct $T_2$ is provided at its closed front end with a radial slot $L_5$ arranged, with the table 1 in a retracted part of the transfer stroke, to move to a position opposite the slot $L_2$ of the guiding tube $G_2$ in order to connect the duct $T_2$ to the common duct 10 of the large nozzles 3. The third cylindrical duct $T_3$ is provided at its closed front end with a radial slot $L_6$ arranged, with the table 1 in a retracted or rearward part of the transfer stroke, to move to a position opposite the slot $L_3$ of the third guiding tube $G_3$ in order to connect the duct $T_3$ to the common duct 11 of the small nozzles 4.

More information concerning the arrangement and the dimensions of the various grooves $R_a$, $R_p$, $R_1$, $R_2$, $R_3$ and the slots $L_1$ to $L_6$ may be gathered from the FIG. 3 to 6 which contain also the main angular positions of the various grooves starting from a 0 reference axis. As has been stated, the aforesaid distributory system is designed to, during a sheet transfer cycle corresponding to a 360° revolution of the shaft 81, apply vacuum by aspiration at a first stage, i.e., in the retracted position of the table 1, to the large nozzles 3, and, subsequently, to the small nozzles 4 before applying blowing pressure to the large and small nozzles 3, 4 towards the forward part of the stroke of table 1.

The above-described transfer device can be provided with a retardation mechanism (not represented) withholding the beginning of the suction as required by the size, i.e., the length of the sheet taken from the batch. In fact, considering that:

1. the lengthwise shift of the cylindrical duct $T_1$, $T_2$, $T_3$ with regard to the corresponding guiding tube $G_1$, $G_2$, $G_3$ commands, i.e., achieves, the switching-over from sucking to blowing at a fixed point of the stroke of the table 1, and
2. the rotary shaft D achieves the switching-over from blowing to sucking in the vicinity of the retracted position of the table 1, it is possible, in a transfer cycle, to have the aspiration set in sooner or later as required by the sheet size. To this aim, the retardation mechanism is to detect the sheet length and to, consequently, vary the angular position of the shaft D that would correspond to the beginning of a transfer cycle. This method allows flexibility in the event of a diminishing sheet length so that the sucking nozzles will be uncovered at an earlier stage. The time-lag intervening before suction sets in will thus enhance the operational safety of the transfer device.

Although the present invention has been described with reference to a specific embodiment, those of skill in the art will recognize that changes may be made thereto without departing from the scope and spirit of the invention as set forth in the appended claims.

I claim as my invention:

1. A transfer device for a machine which converts plate or sheet-like matter into package, fashioned to transfer a last, lowermost, sheet of a batch to a subsequent processing station, communicating to a source of pressure and a source of aspiration, comprising:

a transfer table provided with at least one assembly of nozzles and a control means, wherein the nozzles of said assembly can be flow connected together through said control means either to said source of aspiration so as to operate as suction cups with which the table is able to pick up and transfer the sheets, or alternatively, at an end of a transfer operation, to said source of pressure allowing detachment of the sheets from said table;

a frame supporting said table, said frame providing flow passages to said nozzles;

means for guiding movement of said table; and wherein said control means includes a fixed housing provided with inlet and outlet chambers, such said inlet chamber flow connected to one of said source of aspiration and said source of pressure, a distributory shaft arranged for rotation inside said housing and arranged perpendicularly to the sheet transfer direction, and a radial periphery of said shaft having a plurality of groove-shaped pathways arranged for selectively flow connecting the inlet chambers to selective outlet chambers as determined by an angular position of said distributory shaft;

said housing is extended on one of its side by a plurality of conduits arranged in the transfer direction and flow connected to said outlet chambers;

a plurality of guiding bores are formed in the frame of the table, each bore allowing inside free tight sliding of one of said conduits so as to enable the shifting of said table with regard to said housing when a sheet is transferred; and an aperture is formed into each conduit and is arranged as determined by the lengthwise position of each conduit to move in alignment with a corresponding aperture formed into each corresponding guiding bore in order to flow connect said conduits to said flow passages.

2. A transfer device according to claim 1, wherein said at least one assembly of nozzles comprises a first assembly of large nozzles situated in a rear area of said table flow connected by a first flow passage; and a second assembly of small nozzles situated in a front area of said table flow connected by a second flow passage;

and said plurality of guiding bores and conduits comprise first, second and third guiding bores and first, second and third corresponding conduits wherein said first bore and said first conduit are arranged to direct compressed air to said first and second flow passages for said small and said large nozzles, said second bore and said second conduit are arranged to provide suction to said first flow passage for said large nozzles, and said third bore and said third conduit are arranged to provide suction to said second flow passage for said small nozzles;

said distributory shaft is hollow and wherein said groove-shaped pathways comprise a first assembly of suction grooves and a second assembly of pressure grooves opposite the suction grooves of the first assembly of suction grooves, some of said suction grooves or said pressure grooves being flow connected inside the hollow distributory shaft by radial orifices; and said shaft is synchronized for a revolution of 360° of the distributory shaft corresponding to the complete reciprocation cycle of the table in the course of a transfer of a sheet, and that when the table is in a forward section of its stroke, said source of pressure will be connected to said flow passages of said small and large nozzles by at least one said corresponding aperture formed in said first guiding bore and at least one said aperture formed at a front end of said first conduit, directing compressed air to said small and large nozzles.

3. A transfer device according to claim 2 wherein the distributory shaft is selectively angularly adjustable to retard the beginning of suction of a transfer cycle by angular positioning of the distributory shaft as required by the length of the sheets of a given batch.

4. A transfer device according to claim 1, 2 or 3, wherein the body of at least one nozzle includes a first, fixed tube, a second tube surrounding the first tube and making up a first tight chamber with the first tube, and a third, movable tube topped by a suction cup and surrounding the second tube and making up a second tight chamber with the second tube, the two chambers being interconnected by an inside conduit of the first tube so that with the latter containing vacuum, a difference of pressure being produced between the two chambers results in a shift of the third tube.

5. A transfer device for a machine which converts plate or sheet-like matter into package, fashioned to transfer a last, lowermost, sheet of a batch to a subsequent processing station, communicating with a source of aspiration and a source of pressure, comprising:

a transfer table provided with a first assembly of nozzles, and a second assembly of nozzles, said nozzles of each assembly commonly flow connected by a first flow passage and a second flow passage respectively, formed within said table, said assemblies fashioned to transfer suction from said respective flow passage, or alternatively transfer pressure from said respective flow passage to a sheet-like matter or plate lying thereover;

means for supporting said table and guiding movement of said table along a sheet transfer direction;

a control means including a fixed housing having inlet and outlet chambers, each said inlet chamber flow connected to one of said source of aspiration and said source of pressure, a distributory shaft arranged for rotation inside said housing and a radial periphery of said shaft having a plurality of groove-shaped pathways arranged for selectively flow connecting the inlet chambers to selective outlet chambers as determined by an angular position of said distributory shaft; and a flow transport means for communicating pressure, or alternatively, suction selectively from said outlet chambers to said flow passages.

6. A transfer device according to claim 5, wherein said flow transport means comprises:

a plurality of conduits extending from said housing in the transfer direction and flow connected to said outlet chambers;

a plurality of guiding bores formed into a framework of said table, each guiding bore allowing inside free tight sliding of one of said conduits thereinto, so as to enable a shifting of said table with regard to said housing when a sheet is transferred; and an aperture formed into each conduit and arranged as determined by the lengthwise position of such conduit to move in alignment with a corresponding aperture formed into each corresponding guiding bore in order to selectively flow connect said conduits to selective flow passages.

7. A transfer device according to claim 6 wherein:

said first assembly of nozzles comprise large nozzles situated in a rear area of said table;

said second assembly of nozzles comprise relatively small nozzles situated in a front area of said table;

said plurality of guiding bores and conduits comprise first, second and third guiding bores and first, second and third corresponding conduits wherein said first bore and said first conduit are arranged to direct compressed air to said small and the large nozzles, said second bore and said second conduit are arranged to provide suction to said large nozzles, and said third bore and said third conduit are arranged to provide suction to said small nozzles; and said distributory shaft is hollow and wherein said groove-shaped pathways comprise a first assembly of suction grooves and a second assembly of pressure grooves opposite the suction grooves of the first assembly of suction grooves, some of said suction grooves of said pressure grooves being flow connected inside the hollow distributory shaft by radial orifices; and said shaft is synchronized for a revolution of 360° corresponding to the complete reciprocation cycle of the table in the course of a transfer of a sheet, and that when the table is in a forward position of its stroke, said source of pressure will be connected to said flow passages of said small and large nozzles by at least one said corresponding aperture formed in said first guiding bore and at least one said aperture formed at a front end of said first conduit, directing compressed air to said small and large nozzles.

8. A transfer device according to claim 7 wherein the distributory shaft is selectively angularly adjustable to retard the beginning of suction of a transfer cycle by angular positioning of the distributory shaft as required by the length of the sheets of a given batch.

9. A transfer device according to claim 5, 6 or 7, wherein the body of at least one nozzle includes a first, fixed, tube, a second tube surrounding the first tube and making up a first tight chamber with the first tube, and a third, movable tube topped by a suction cup and surrounding the second tube and making up a second tight chamber with the second tube, the two chambers being interconnected by an inside conduit of the first tube so that with the latter containing vacuum, a difference of pressure being produced between the two chambers results in a shift of the third tube.

10. A sheet transfer device communicating to a source of air pressure and a source of aspiration, comprising:

a transfer table movable reciprocally in a sheet transfer direction, provided with a first assembly of nozzles, and a second assembly of nozzles, said nozzles of each assembly commonly flow connected by a first flow passage and a second flow passage respectively, said assemblies fashioned to transfer aspiration from said respective flow passage, or alternatively transfer air pressure from said respective flow passage to a sheet;

a control means including a fixed housing flow connected to said source of aspiration and said source of air pressure;

a plurality of conduits extending from said housing in the sheet transfer direction, said control means selectively distributing either aspiration or air pressure to said conduits;

a plurality of guiding bores formed into a framework of said table, each guiding bore allowing inside free tight sliding of one of said conduits thereinto, so as to enable a shifting of said table with regard to said housing when a sheet is transferred; and a first aperture formed into each conduit and arranged as determined by the lengthwise position of each conduit to move in alignment with a corresponding second aperture formed into each corresponding guiding bore, said second apertures flow connected to at least one of said first and second flow passages.

11. A transfer device according to claim 10, wherein said plurality of guiding bores and conduits comprise first, second and third guiding bores and first, second and third corresponding conduits wherein said first bore and said first conduit are arranged to direct compressed air to said first flow passage and said second flow passage, said second bore and said second conduit arranged to provide aspiration to said first flow passage, and said third bore and said third conduit are arranged to provide aspiration to said second flow passage.

12. A transfer device according to claim 10, wherein said control means comprises a distributory shaft arranged for rotation inside said housing and having a radial periphery with a plurality of groove-shaped pathways arranged for selectively flow connecting either aspiration or air pressure to selective ones of said conduits.

13. A transfer device according to claim 12, wherein said distributory shaft is hollow and wherein said groove-shaped pathways comprise an assembly of pressure grooves, a first one of said pressure grooves aligned with said source of air pressure, a second one of said pressure grooves aligned with one of said conduits, said pressure grooves having radial orifices flow connecting the pressure grooves to an inside volume of the hollow distributory shaft; and when the table is in a forward position of its stroke, said source of air pressure will be flow connected to the first one of said pressure grooves and the second one of said pressure grooves will be oriented communicating compressed air into said one conduit via said inside volume of said hollow distributory shaft and said first one of said pressure grooves.

14. A transfer device according to claim 10, wherein said plurality of guiding bores and conduits comprise first, second and third guiding bores in first, second and third corresponding conduits wherein said first bore and said first conduit are intermittently flow connected to both said first flow passage and said second flow passage, said second bore and said second conduit are intermittently flow connected to said first flow passage, and said third bore and said third conduit are intermittently flow connected to said second flow passage.

15. A transfer device according to claim 14, wherein said control means comprises a distributory shaft arranged for axial rotation inside said housing and having a radial periphery with a plurality of pressure grooves arranged axially along a length of the distributory shaft, a first pressure groove oriented to rotate axially through a pressure arc in flow communication with said source of air pressure, a second pressure groove oriented to be open into flow communication with said second conduit sometime during rotation of said first pressure groove through said pressure arc, and a third pressure groove oriented to open into flow communication with said third conduit sometime during rotation of said first pressure groove through said pressure arc, said first, second and third pressure grooves flow connected by said hollow distributory shaft.

16. A transfer device according to claim 14, wherein said control means comprises a distributory shaft arranged for axial rotation inside said housing and having a radial periphery with a plurality of suction grooves arranged along a length of the distributory shaft, wherein said plurality of suction grooves comprise a first suction groove oriented to rotate into flow communication with said source of aspiration through a suction arc, a second suction groove flow open to said first suction groove and oriented to rotationally flow open to said second conduit sometime during rotation of said first suction groove through said suction arc, and a third suction groove flow open to said first suction groove oriented to rotationally flow open to said third conduit sometime during rotation of said first suction groove through said suction arc.

* * * * *